United States Patent [19]

Cameron

[11] 4,217,019

[45] Aug. 12, 1980

[54] EMI PROTECTED CONNECTOR ASSEMBLY

[75] Inventor: John K. Cameron, Wheaton, Ill.

[73] Assignee: Bunker Ramo Corporation, Oak Brook, Ill.

[21] Appl. No.: 872,187

[22] Filed: Jan. 25, 1978

Related U.S. Application Data

[62] Division of Ser. No. 743,302, Nov. 19, 1976, abandoned.

[51] Int. Cl.[2] ..... H01R 13/44

[52] U.S. Cl. ..... 339/40; 339/43

[58] Field of Search ..... 339/36, 40, 41, 42, 339/43, 44 R, 44 M; 160/133; 220/336

[56] References Cited

U.S. PATENT DOCUMENTS

| | | | |
|---|---|---|---|
| 1,060,011 | 4/1913 | Newton | 339/43 |
| 1,481,368 | 1/1924 | Hope | 339/40 |
| 2,513,152 | 6/1950 | Delivuk | 160/133 |
| 2,621,038 | 12/1952 | Boyd | 49/200 |
| 2,625,621 | 1/1953 | Roby | 160/4 |
| 4,119,813 | 10/1978 | Sato | 339/40 |

FOREIGN PATENT DOCUMENTS

| | | | |
|---|---|---|---|
| 1183324 | 12/1964 | Fed. Rep. of Germany | 220/336 |
| 1211303 | 2/1966 | Fed. Rep. of Germany | 339/40 |
| 2229543 | 2/1973 | Fed. Rep. of Germany | 339/44 R |

*Primary Examiner*—Neil Abrams

*Attorney, Agent, or Firm*—F. M. Arbuckle; J. R. Hoffman

[57] ABSTRACT

A connector assembly providing uninterrupted protection against electromagnetic interference includes a receptacle having a recess in which a first contact assembly is positioned, and a plug having a mating portion which fits into the recess. The mating portion contains a second recess in which a second contact assembly is positioned to mate with the first contact assembly as it projects into the second recess from the first recess. Pivotally mounted doors within the first and second recesses protect the contact assemblies from radiation when unmated, and a spring contact between the mating portion of the plug and the walls of the first recess protect the contact assemblies from radiation during transition between unmated and mated conditions.

5 Claims, 14 Drawing Figures

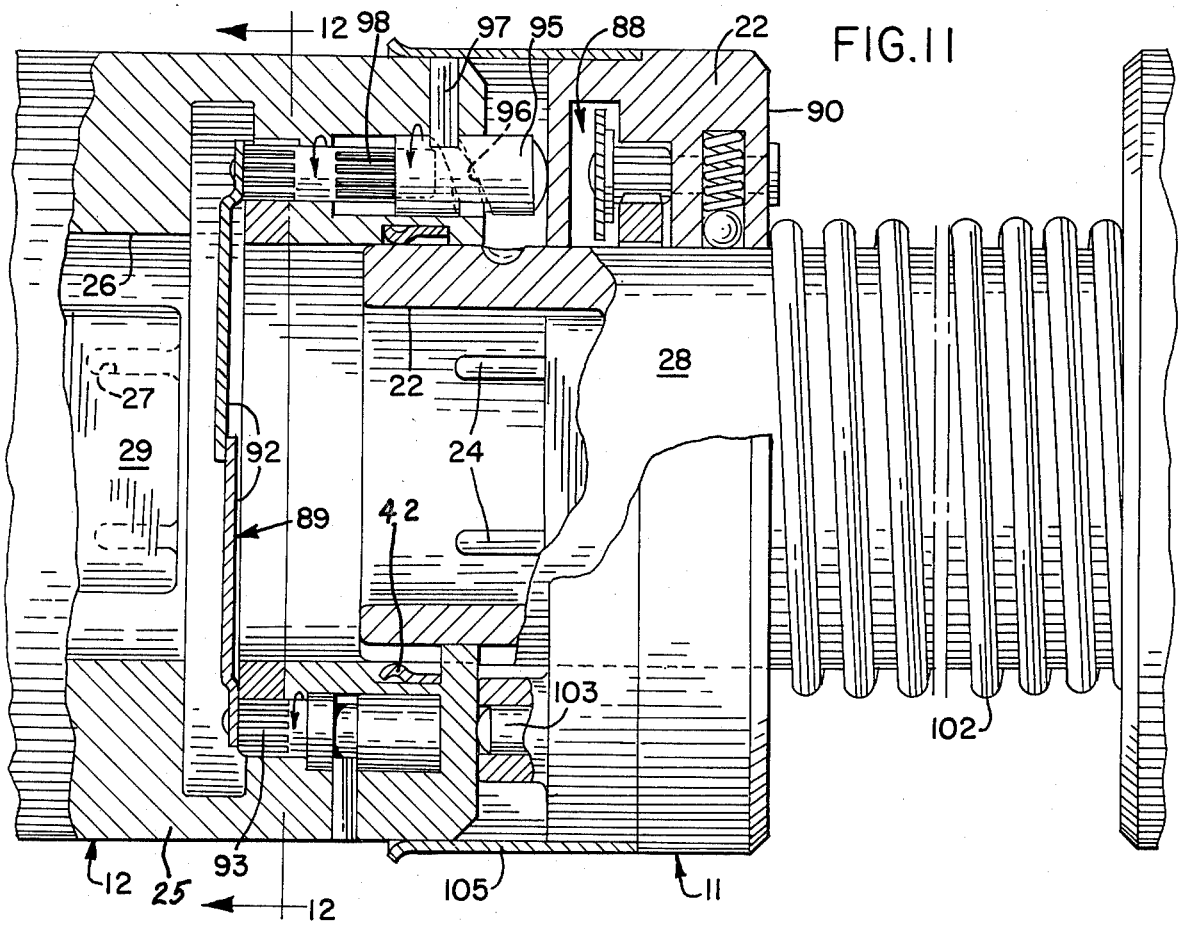
FIG.11
FIG.12
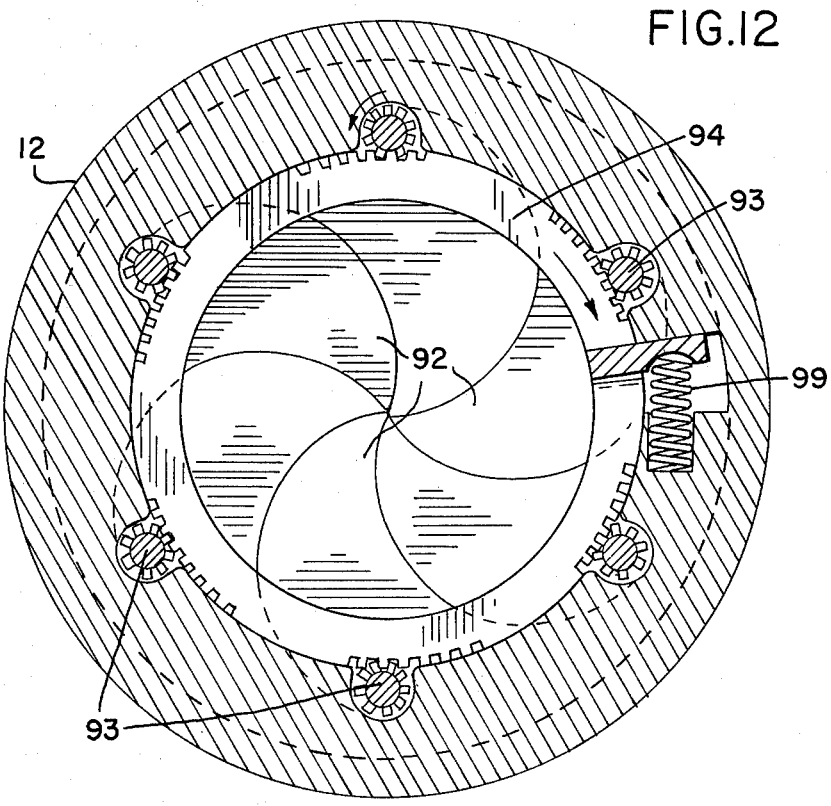

EMI PROTECTED CONNECTOR ASSEMBLY

This is a divisional application of application Ser. No. 743,302, filed Nov. 19, 1976 now abandoned.

BACKGROUND OF THE INVENTION

The present invention is directed generally to connector assemblies, and more particularly to a connector assembly which provides uninterrupted electrical shielding and mechanical protection for associated electrical circuits in both its mated and unmated conditions.

This is a division of my prior application Ser. No. 743,302, filed Nov. 19, 1976, which has been abandoned in favor of my copending continuation application Ser. No. 879,339, filed Feb. 21, 1978, entitled EMI PROTECTED CONNECTOR ASSEMBLY and assigned to the assignee of the present application.

In certain critical connector applications, such as where low level interference-prone circuits must be interconnected in the presence of a strong radio frequency (RF) field, or in a hostile dust or moisture environment, it is necessary to provide an electrical connector assembly which provides uninterrupted shielding of its contacts against electromagnetic radiation interference (EMI) and contaminants in the environment. Connector assemblies heretofore utilized for this purpose utilized separate protective caps which had to be individually removed prior to mating the connectors, making the connector assemblies more difficult to mate and exposing the contacts of the connectors, and hence associated electrical circuits, to EMI and contamination during the period between removal of the caps and mating of the connectors.

The present invention provides a connector assembly wherein the electrical contacts of the assembly are continuously and automatically shielded in both unmated and mated conditions, and during the transition between these conditions, to achieve uninterrupted protection for associated electrical circuits.

Accordingly, it is a general object of the present invention to provide a new and improved connector assembly for interconnecting critical electrical circuits in an adverse environment.

It is another object of the present invention to provide a new and improved connector assembly which provides continuous protection to associated electrical circuits against EMI and environmental contamination in both its unmated and mated conditions, and during the transition therebetween.

It is another object of the present invention to provide a new and improved connector assembly which can be more easily mated while continuously maintaining EMI and environmental protection to associated electrical circuits.

SUMMARY OF THE INVENTION

The invention is directed to a connector assembly comprising a receptacle housing having a plug-receiving recess at one end thereof in which a first contact assembly is positioned, and a plug housing having a mating portion thereof dimensioned to extend into the plug-receiving recess, and a second contact assembly at the end of the mating portion adapted to mate with the first contact assembly. To provide EMI and environmental protection for the first contact assembly, closure means are carried on at least one of the housings forwardly at the contact assembly therein for enclosing the contact assembly within the recess, the closure means opening upon insertion of the mating portion into the plug-receiving recess.

The invention is further directed to a connector assembly comprising a receptacle housing having a plug-receiving recess at one end thereof in which a first contact assembly is positioned, and a plug housing having a mating portion thereon dimensioned to extend into the plug-receiving recess. A contact assembly-receiving recess is provided at the end of the plug mating portion for receiving the first contact assembly, and a second contact assembly is positioned within the contact-receiving recess for connecting with the first contact assembly when the mating portion is seated in the first recess. To provide EMI and environmental protection for the contact assemblies, first closure means are provided within the first recess intermediate the ends thereof for enclosing the first contact assembly within the recess, these first closure means opening upon entry of the mating portion within the first recess, and second closure means are provided within the second recess intermediate the ends thereof for enclosing the second contact assembly within the second recess, these second closure means opening upon entry of the first contact assembly within the second recess.

BRIEF DESCRIPTION OF THE DRAWINGS

The features of the present invention, which are believed to be novel, are set forth with particularity in the appended claims. The invention, together with the further objects and advantages thereof, may best be understood by reference to the following description taken in connection with the accompanying drawings, in the several figures of which like reference numerals identify like elements, and in which

FIG. 11 is an enlarged side elevational view, partially in cross-section and partially broken away, of another alternate embodiment of the invention wherein mechanically operated iris-type closure mechanisms are provided to enclose the electrical contacts of the connector assembly.

FIG. 12 is a cross-sectional view of the connector assembly taken along line 12—12 of FIG. 11 illustrating the iris-type closure mechanism.

DESCRIPTION OF THE PREFERRED EMBODIMENT

Figure 1:
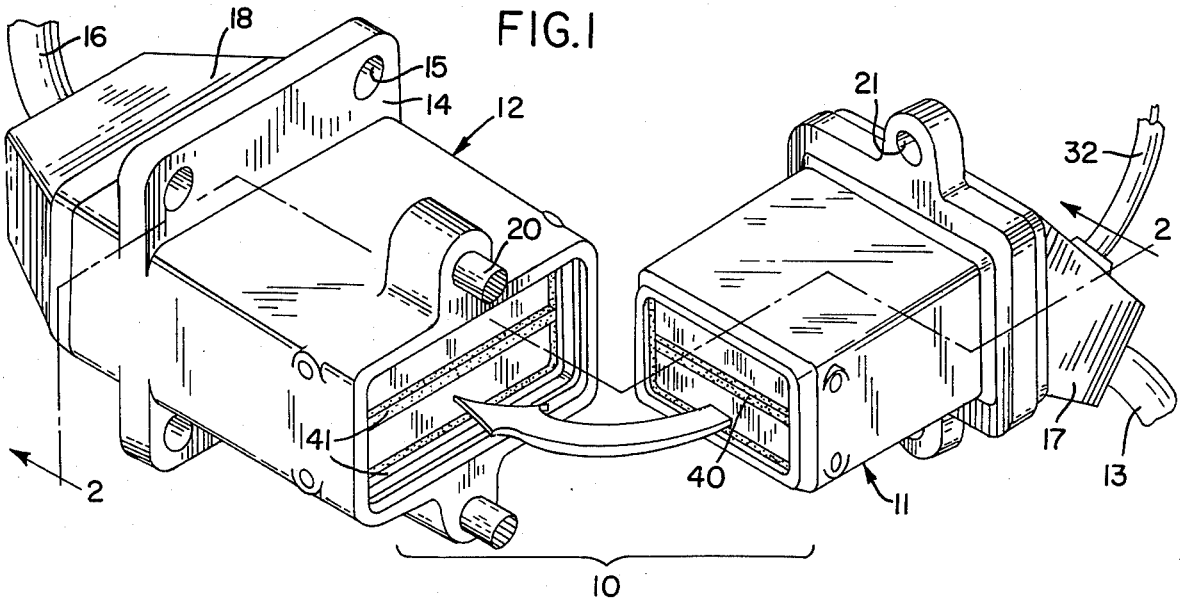
FIG. 1 is a perspective view of a connector assembly constructed in accordance with the invention shown in an unmated condition.
Figure 2:
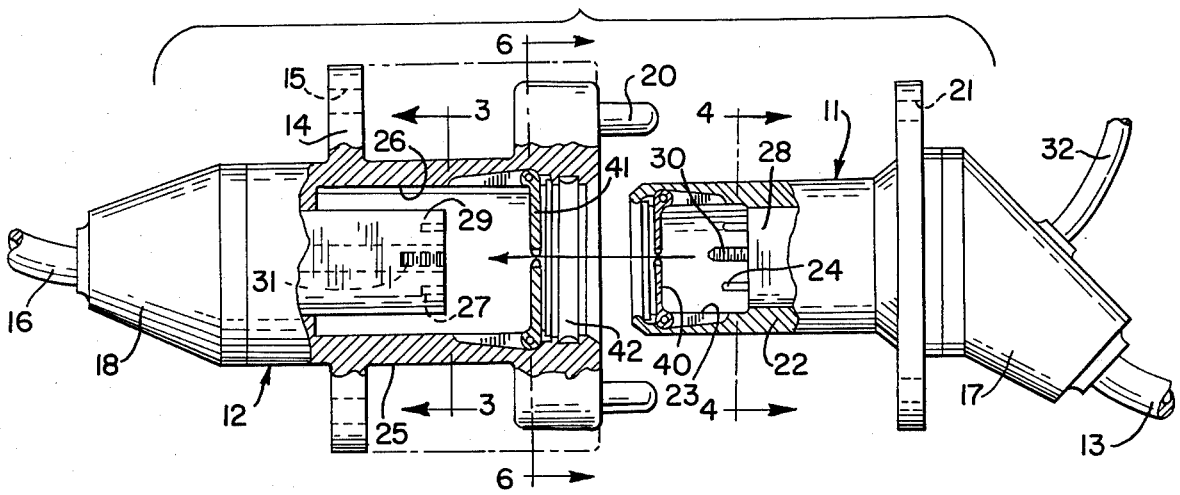
FIG. 2 is a side elevational view of the connector assembly of FIG. 1 partially in cross-section to show the principal elements of the assembly.

Referring to the figures, and particularly to FIGS. 1 and 2, a connector assembly 10 constructed in accordance with the invention includes a plug 11 adapted to mate with a receptacle 12. Plug 11 is intended for cable mounting, and is installed at the end of an electrical cable 13. Receptacle 12 is intended for mounting to an external wall or bulkhead (not shown), including a flange portion 14 having fastener-receiving apertures 15 for this purpose, and is installed on the end of an electrical cable 16. Strain relief for the electrical cables and protection against probing of the electrical connections of the plug and receptacle are provided by end covers 17 and 18, respectively.

To provide for more positive alignment between plug 11 and receptacle 12 when the connector assembly is in a mated condition, receptacle 12 includes a pair of longitudinally-extending locating pins 20 which are received in complimentarily dimensioned apertures 21 on the plug portion of the connector assembly. In addition to providing more positive alignment, alignment pins increase the mechanical rigidity of the mated connector assembly and make it less susceptible to disengagement from externally applied forces.

As best seen in FIG. 2, plug 11 includes an elongated housing 22 of generally rectangular cross-section which defines an open-ended recess or compartment 23 within which a plurality of electrical contacts 24 associated with the plug are contained. Similarly, receptacle 12 includes an elongated housing 25 of generally rectangular cross-section which defines an open-ended plug-receiving recess or compartment 26 within which a plurality of electrical contacts 27 associated with the receptacle are contained. The interior dimensions of compartment 26 allow a mating portion 22*a* of plug housing 22 to be slidably received therein when the connector assembly is mated.

Figure 3:
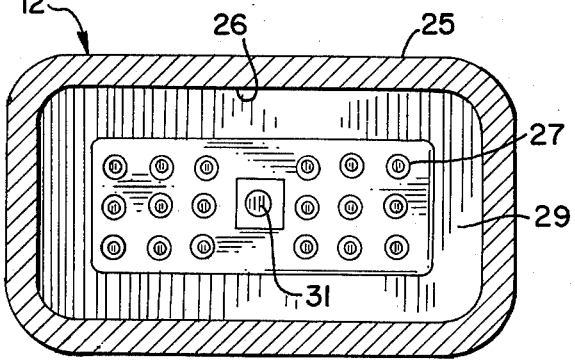
FIG. 3 is an enlarged cross-sectional view of the connector assembly taken along line 3—3 of FIG. 2.
Figure 4:
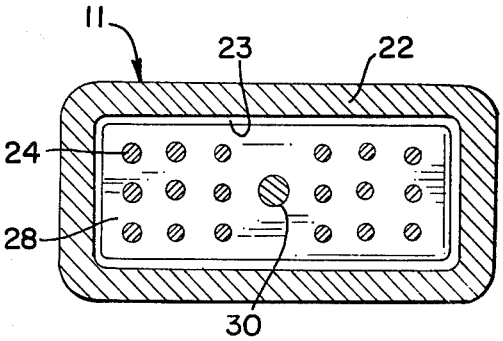
FIG. 4 is an enlarged cross-sectional view of the connector assembly taken along line 4—4 of FIG. 2.

Referring to FIGS. 3 and 4, contacts 24 and 27 are mounted in a conventional manner on individual dielectric insert blocks 28 and 29 to form contact assemblies 28*a* and 29*a* within compartments 23 and 26, respectively. The arrangement of the terminals on the dielectric insert blocks 28 and 29 is such that when plug 11 and receptacle 12 are mated respective ones of the contacts are brought into mating engagement. Although contacts 24 are shown as pin-type male contacts, and contacts 27 are shown as female contacts within which the pin contacts 24 seat, it will be appreciated that contacts 24 and 27 can be of either gender, or mixed gender, and that other types of contacts, including shielded contacts, can be utilized as well.

Once mated, plug 11 and receptacle 12 are locked together by means of a locking screw 30 which extends through dielectric insert block 28 and into engagement with a complimentarily threaded bore 31 provided on the surface of dielectric insert block 29. Locking screw 30 may be turned by means of a flexible drive cable 32 which rotatably couples the locating screw to suitable drive means such as a hand crank or electric motor.

In accordance with the invention, EMI and environmental protection is provided for terminals 24 and 27 by closure means in the form of pivotally mounted doors 40 and 41 which are mounted over the open ends of compartments 23 and 26, respectively, and which automatically open when the plug and receptacle are mated. In the illustrated embodiment plug 11 includes two such doors 40 pivotally mounted to opposite walls of chamber 23 and spring biased to a closed position whereby the open end of the chamber is closed. Similarly, receptacle 12 includes two such doors 41 pivotally mounted to opposite walls of chamber 26 and spring biased to a closed position whereby the open end of that chamber is closed. Additional sealing means is the form of an electrically-conductive spring strip 42 adjacent the open end of chamber 26 are provided to establish electrical continuity between housings 22 and 25 as plug 11 and receptacle 12 are first brought into engagement and prior to either doors 40 or 41 opening.

Figures 5, 5A, 5B:
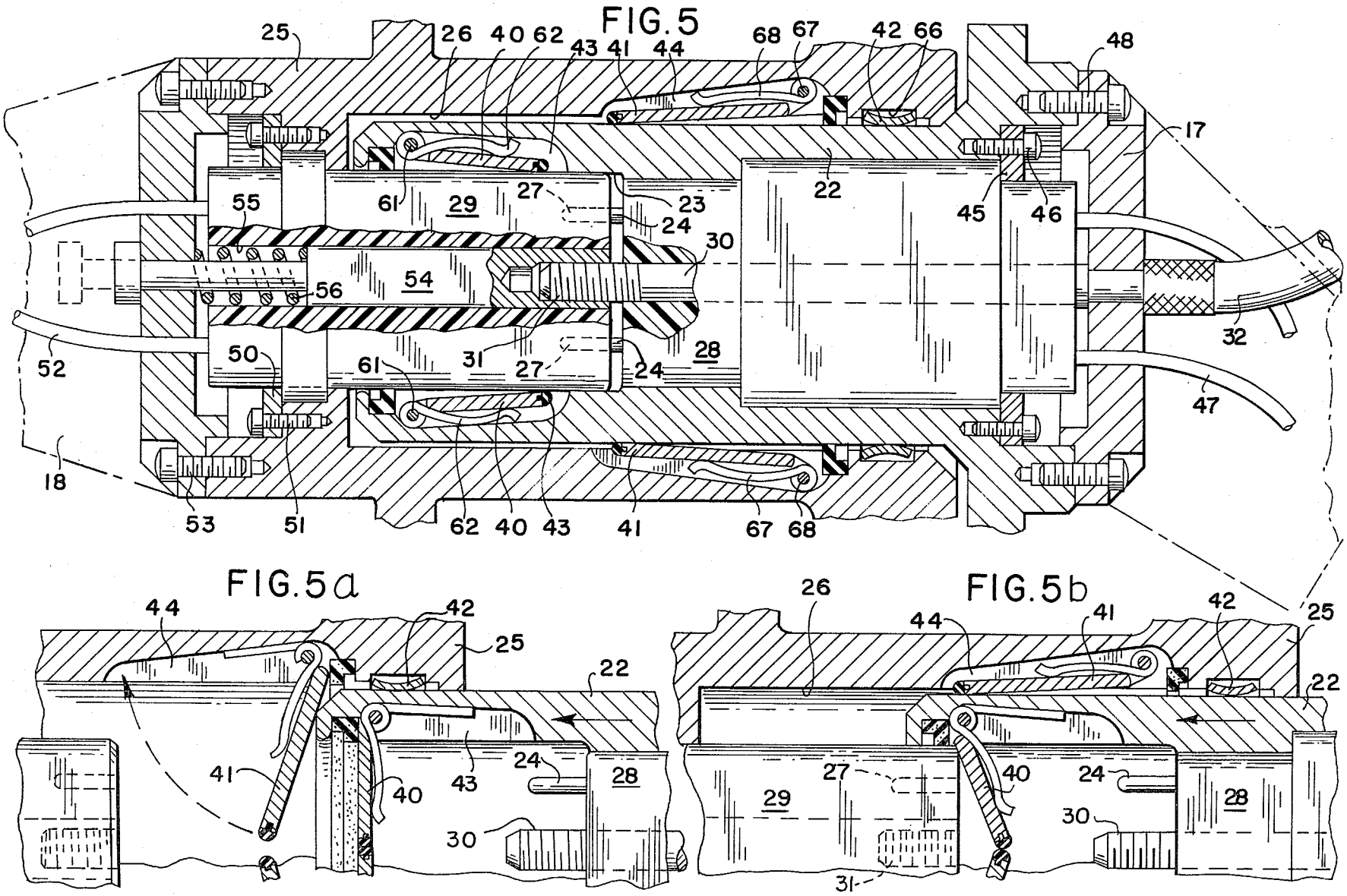
FIG. 5 is an enlarged side elevational view of the connector assembly in a mated condition partially broken away and partially in cross-section.
FIGS. 5*a* and 5*b* depict portions of the connector assembly shown in FIG. 5 as the connector assembly is mated.

Referring to FIG. 5, when plug 11 and receptacle 12 of connector assembly 10 are fully mated, protective doors 40 and 41 pivot into recesses 43 and 44 provided within the side walls of chambers 23 and 26, respectively. Protective doors 40 are held open by dielectric insert block 29, which is then located within compartment 23, and protective doors 41 are held open by housing 22, which is then located within compartment 25. Although both sets of protective doors are open, EMI shielding is maintained for contacts 24 and 27 by spring strip 42 which, by reason of being positioned at the open end of compartment 26 outwardly of protective doors 41, establishes a shielding engagement between housing 22 and housing 25 before the protective doors are pushed open. This assures that EMI protection will be maintained uninterrupted during the mating operation.

The mating operation is illustrated by FIGS. 5*a* and 5*b*. Initially, as the mating portion 22*a* of plug housing 22 is pushed into receptacle compartment 26 spring strip 42 establishes electrical continuity between housings 22 and 25. Then, as the plug housing is inserted farther, the protective doors 41 of receptacle 12 are pushed open and into recesses 44, as shown in FIG. 5*a*. Next, dielectric insert block 29 pushes the protective doors 40 of plug 11 open and into recess 43, as shown in FIG. 5*b*, allowing contacts 24 and 27 to mate, as shown in FIG. 5. Since neither protective doors 40 or 41 are opened until electrical continuity has been established between housing 22 and 25 by spring strip 42, contacts 24 and 27 are protected from EMI and the environment at all times. It will be appreciated that other means for opening and closing the doors 40 and 41 may be utilized, such as an actuator mechanism as described in detail below.

Dielectric insert block 28 is held in position by a retainer plate 45 attached to the rear end of housing 22 by machine screws 46 or other appropriate fastening means. Electrical connections are established between terminals 24 and the individual electrical conductors 47 of cable 13 in a conventional manner within insert block 28. The connector shell 17 may be attached to housing 22 by machine screws 48 or other appropriate fastening means.

Dielectric insert block 29 is similarly held in position by a retainer plate 50 attached by machine screws 51 or other appropriate fastening means to the rear end of housing 26. Electrical connections are established between the terminals 27 of insert block 29 and the individual electrical conductors 52 of cable 16 in a conventional manner within insert block 29. The connector shell 18 may be attached to housing 26 by machine screws 53 or other appropriate fastening means.

The threaded bore 31 into which the locking screw 30 is threaded is located on one end of an elongated longitudinally-extending retaining member 54 slidably mounted within a bore 55 extending through the center of dielectric insert block 29. The other end of this retaining member includes a head portion of increased diameter which anchors that end to the base of end cover 18. Screw 30 is similarly anchored to the base of end cover 17 so that as screw 30 is threaded into bore 31 plug 11 and receptacle 12 are drawn together and contacts 24 and 27 are tightly joined. A helical spring 56 between the inside surface of end cover 18 and the inside shoulder of retaining member 54 biases that member flush with the surface of dielectric insert block 29 to facilitate starting locking screw 30 in bore 31.

Figure 6:
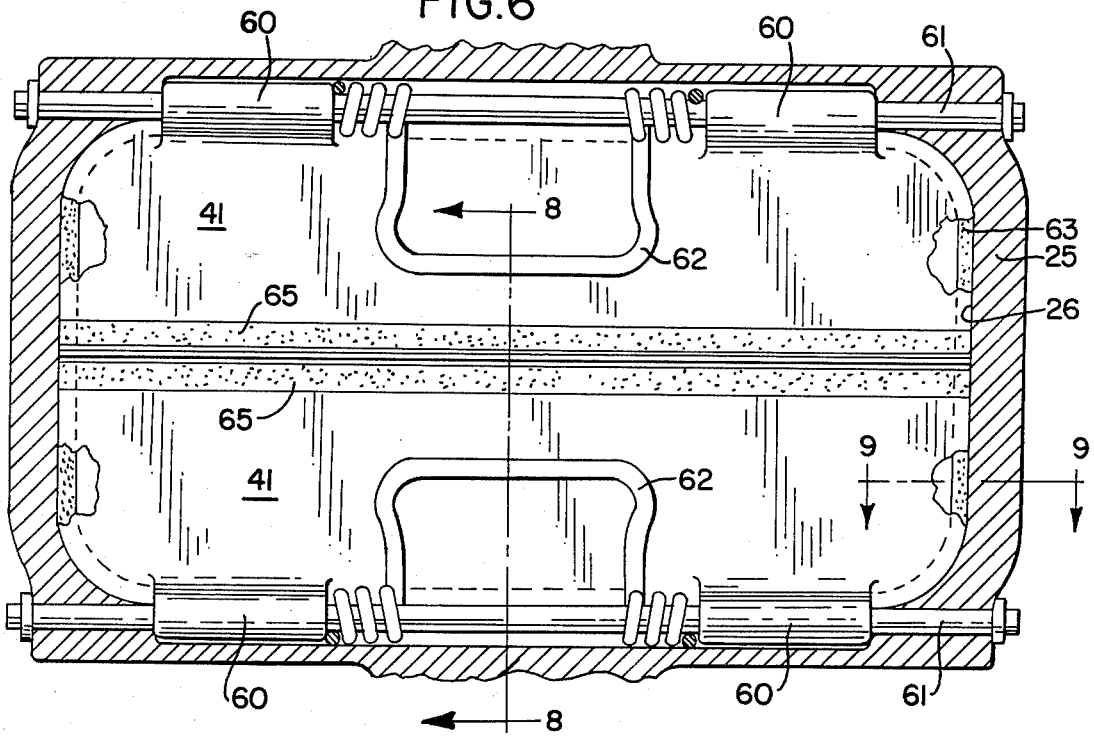
FIG. 6 is an enlarged rear elevational view of the protective doors utilized to enclose the contacts of the connector assembly.
Figure 7:
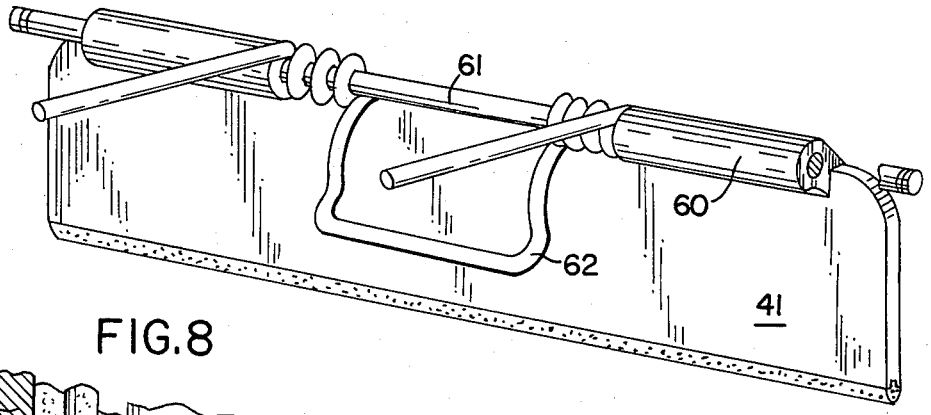
FIG. 7 is an enlarged perspective view of the pivoted end of one of the protective doors of FIG. 6 showing the spring assembly utilized to bias the doors to a closed position.

Referring to FIG. 6, protective doors 41, which are also representative of the construction of doors 40, are proportioned and arranged to fit closely though not tightly so that when closed they provide an effective barrier against EMI and environmental contamination. The doors have at their opposite sides or edges pivot-receiving means in the form of lugs 60 which extend into locking engagement with transversely mounted pivot bars 61. These bars extend through the side walls of compartment 26 so as to pivotally mount each of the doors 41 on opposite side walls. The doors are biased to a closed position by means of springs 62 each having two transversely spaced helical coils positioned around their respective pivot bar 61 with a central bridging portion bearing against their respective door, and with projecting end portions bearing against their respective inside wall of compartment 26.

To obtain the desired EMI shielding and environmental sealing effect the doors 41 are preferably formed of co-electrically conductive metal such as copper, and are arranged to bear against a gasket 63, which is seated against a shoulder 64 around the inside wall of chamber 26. This gasket is preferably formed of an electrically conductive elastomeric material so as to be partially compressed under the force exerted by spring 62, thereby improving electrical and mechanical sealing between housing 25 and the doors 41. The gasket 63 is preferably L-shaped in cross-section, one leg of the L being seated against shoulder 64 and the other leg of the L being arranged to coact with the edges of the doors 41. To further improve the sealing action of the doors, the abutting central edges of the doors may be fitted with strips 65 of elastomeric material similar to that utilized for gasket 63. These strips are similarly compressed under the force of springs 62 when the doors are closed for improved mechanical and electrical sealing.

Figure 8:
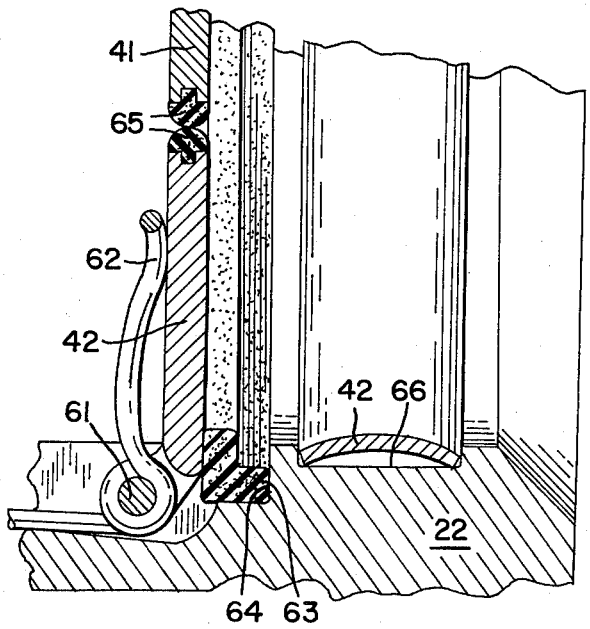
FIGS. 8 and 9 are enlarged cross-sectional views taken along lines 8—8 and 9—9 of FIG. 6 showing the sealing arrangement provided around the edges of the protective doors.
Figure 9:
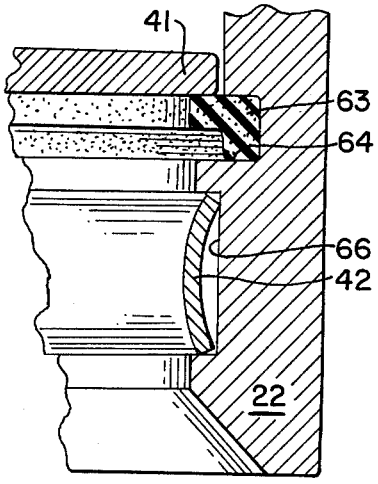

The construction of protective doors 40 may be identical to that of doors 41 except for size, the doors being similarly pivoted about pivot arms 67 and biased closed by springs 68. As best seen in FIGS. 8 and 9, the spring strip 42 utilized to provide EMI protection during the mating process is compressed within a channel 66 provided around the inside wall of chamber 26. The spring strip is preferably formed of an electrically-conductive springy metal such as copper and is of sufficient width so as to be outwardly bowed when positioned in channel 66. Alternatively, the spring strip 42 can be permanently attached to housing 25 by appropriate fastening means such as screws or rivets.

Figure 10:
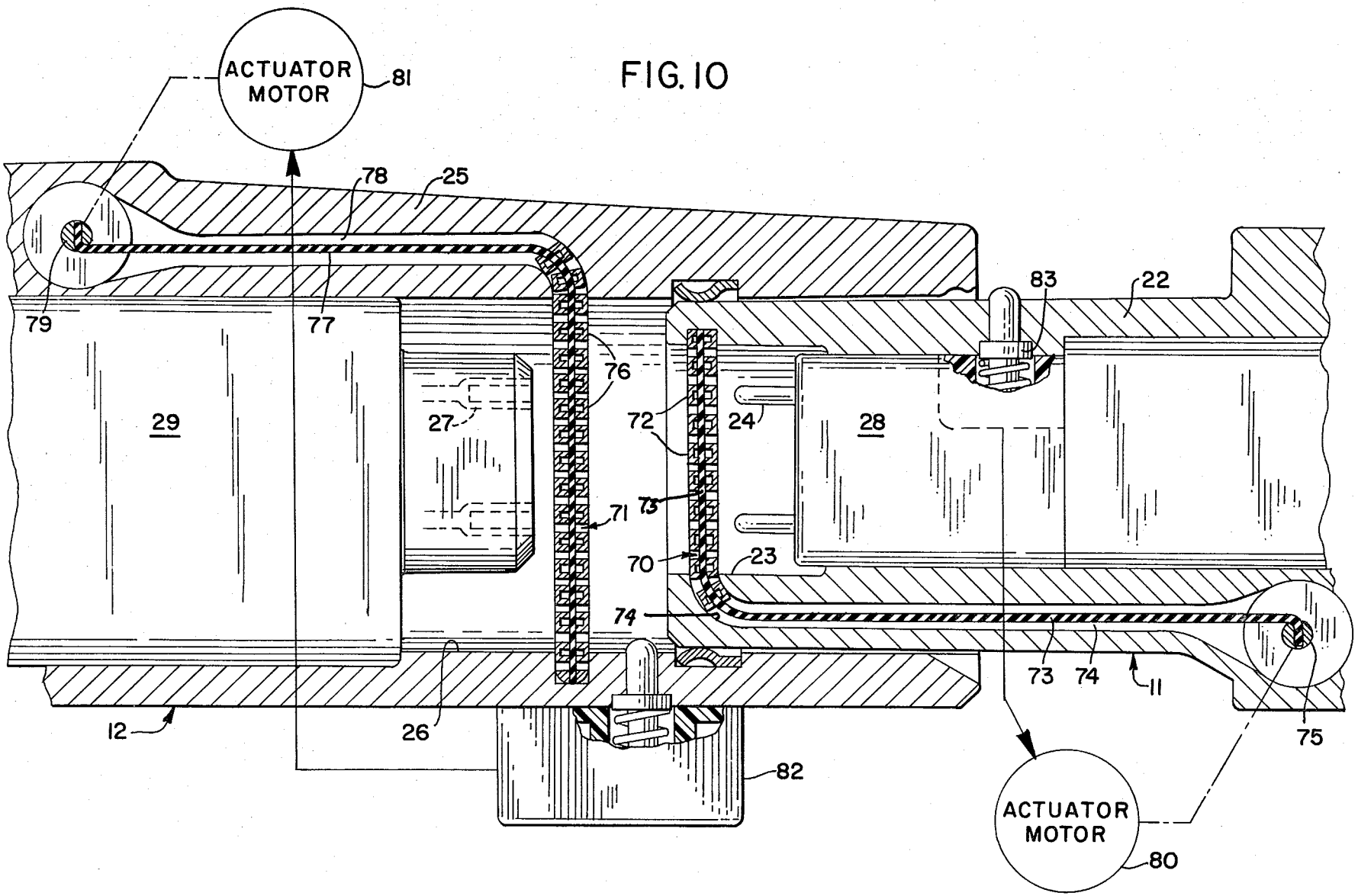
FIG. 10 is an enlarged side elevational view partially in cross-section and partially broken away of an alternate embodiment of the invention wherein electrically operated shutters are utilized in conjunction with position sensing switches to enclose the electrical contacts of the connector assembly.

It will be appreciated that closure means other than pivotally mounted doors can be utilized to protect terminals 24 and 27. One such alternative is illustrated in FIG. 10, wherein sliding shutter assemblies 70 and 71 are provided at the openings of compartments 23 and 26, respectively. Shutter assembly 70 comprises a plurality of slat-like shutters 72 mounted edge-to-edge on a semi-flexible sheet-like carrier 73 so as to slide within channels 74 provided in opposing relationship on opposite side walls of compartment 23. Channels 74 extend from a location across the open end of chamber 23, wherein the shutters are positioned when the assembly is closed, to a rearwardly located position clear of compartment 23 wherein the shutters are positioned when the shutter assembly is open. The shutters are moved within the channels by carrier 73, which is spooled onto an actuator reel 75. In operation, the shutter assembly is opened by turning reel 75 in a clockwise direction (as viewed in FIG. 10), which causes carrier 73 to be wound onto the reel. This causes the shutters to be retracted into the longitudinally-extending portion of channels 74 clear of the open end of compartment 23.

Shutter assembly 71, which is similar to shutter assembly 70 except for size, includes a plurality of shutters 76 attached edge-to-edge to a semi-flexible carrier 77. The shutters are constrained to slide along channels 78 provided in opposing relationship on opposite side walls of compartments 26. The rearwardly extending end of carrier 77 is spooled onto an actuator reel 79 so that a reel 79 is turned clockwise (as viewed in FIG. 10), shutter assembly 71 is retracted to an open position.

To provide automatic opening of shutter assemblies 70 and 71 upon insertion of plug 11 into receptacle 12, actuator reels 75 and 79 are rotatably coupled to respective ones of electric actuator motors 80 and 81. The operation of these motors is controlled by respective ones of position-sensing switches 82 and 83, which are included in conventional motor control circuits (not shown).

In operation, as plug 11 is inserted into receptacle 12, a point is reached at which housing 22 depresses the actuator plunger of control switch 82, causing actuator motor 81 to turn reel 79 clockwise and move shutter assembly 71 to an open position. At the same time, housing 25 depresses the plunger of control switch 83 and causes actuator motor 80 to rotate reel 75 and retract shutter assembly 70. In practice, the shutter assemblies may open very rapidly so that the insertion of plug 11 into receptacle 12 may be accomplished with one continuous motion.

It will be noted that shutter assembly 71 is positioned inside of the electrically conductive spring strip 42, and that control switches 82 and 83 are positioned such that housings 22 and 25 will be electrically interconnected by spring 42 prior to actuation of either switch. Thus, shutter assemblies 70 and 71 remain closed to protect contacts 24 and 27 from EMI and environmental contamination until a seal has been established between housings 22 and 25 by spring strip 42.

It will be appreciated that shutter assemblies 70 and 71 could also be retracted by means of appropriate mechanical linkages. For example, rack-and-pinion assemblies could be provided in conjunction with each reel, the pinion gear of each such assembly being rotatably coupled to the associated reel, and the rack of each such assembly being arranged for actuation by the housing of the opposite half of the connector. With such an arrangement the rack members would drive their respective pinion gears after housings 22 and 25 had become interconnected by spring strip 42, so that the shutter assemblies 70 and 71 would not begin to open until EMI protection had been established.

Another possible construction for the closure means is shown in FIGS. 11 and 12 wherein iris-type shutter assemblies 88 and 89 are provided over the open ends of plug 11 and receptacle 12, respectively. In this instance, housings 22 and 25 are annular in cross-section, housing 22 being provided with a retractable donut-shaped collar 90 in which the shutter assembly 88 for plug 11 is contained.

With the exception of its actuator arrangement, the shutter assembly 89 of receptacle 12 may be similar to that commonly employed in the photographic field. Basically, the shutter assembly 89 comprises a plurality of individual leafs 92 mounted to respective ones of individual pinion gears 93, which are in turn rotatably mounted to housing 25. The pinion gears are rotatably coupled by means of an externally threaded ring gear 94 so that the leafs 92 are caused to extend and retract simultaneously with rotation of any one pinion gear.

To cause retraction of the leafs 92 upon insertion of plug 11, shutter assembly 89 includes an actuator pin 95 positioned so as to be axially displaced upon contact with housing 22. Actuator pin 95 includes a helical groove 96 on its surface which coacts with a pin 97 in housing 25 to impart rotary motion to the actuator pin concurrently with its axial displacement. This rotary motion is imparted to one of the pinion gears 93 by means of a spline coupling 98, so that displacement of actuator pin 95 causes rotation of ring gear 94 and simultaneous retraction of leafs 92. A helical spring 99 between ring gear 94 and housing 25 biases leafs 92 to a closed position so that upon removal of the displacing force from actuator pin 95 the leafs return to a closed position and the actuator pin returns to an extended position.

The iris-type shutter assembly 88 provided at the open end of compartment 22 is similar in construction to assembly 89. This assembly is contained within collar 90, which is forwardly biased by a helical spring 102 positioned around housing 22 so that when plug 11 is in an unmated condition the collar is fully forward. At this time shutter assembly 88 is closed, the individual leafs thereof (not shown) extending across the opening of compartment 22 to provide EMI and environmental protection for contacts 24. Shutter assembly 88 includes an actuator arrangement similar to that of shutter assembly 91, an actuator pin 103 being axially displaced upon contact with housing 25 and rotatably driving a ring and pinion gear (not shown) to open the leafs of the assembly.

It will be appreciated that other actuator arrangements are possible for opening shutter assemblies 88 and 89 upon insertion of plug 11 into receptacle 12. For example, it would be possible to provide rack-and-pinion drive assemblies wherein the pinion gear of each such assembly is rotatably coupled to one of the pinion gears 93, and the rack portion of each such assembly is coupled to the housing of the other half of the connector assembly. Also, it would be possible to utilize a motor-driven arrangement similar to that shown in FIG. 10 wherein the relative position of each connector member is sensed by electrical switches which cause electric motors to rotate pinion gears 93 at the appropriate portion of the mating operation.

To obtain uninterrupted protection for contacts 24 and 27 during the mating operation, the connector assembly of FIG. 11 may include a skirt-type spring contact 105 extending from the front end of collar 90 to establish electrical contact between housing 22 and housing 25 prior to displacement of either pin 95 or pin 103, thereby protecting contacts 24 and 27 from exposure upon opening of the shutter assemblies.

In addition to the embodiments of the invention illustrated, it will be appreciated that other arrangements can be provided in conjunction with connector assembly 10 for closing the open ends of compartments 22 and 26. For example, instead of the two individually pivoted doors shown in FIGS. 1–9, it would be possible to utilize a single protective door pivoted at one end in plug 11 and receptacle 12. The operation of these doors would be similar to that of doors 40 and 41, except that larger recesses would be required on the inside walls of compartments 23 and 26 to accommodate these doors in their retracted positions.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. A connector assembly comprising, in combination:

a receptacle member including a housing having a forward end and a plug-receiving recess extending rearwardly from said forward end;

first contact means disposed within said plug-receiving recess;

a plug member including a housing having a forward mating end portion externally dimensioned for telescoping insertion into said plug-receiving recess;

second contact means disposed within said plug member for engagement with said first contact means when said forward mating portion of said plug member is inserted into said plug-receiving recess;

closure means disposed on at least one of said housings for enclosing the contact means disposed therewithin, said closure means comprising a shutter assembly which includes a plurality of slat-like shutters mounted edge-to-edge for reciprocation between a closed position across the recess of said one housing and an open position substantially clear of said recess; and actuator means disposed on said one of said housings and operatively associated with said shutter assembly disposed thereon, said actuator means including an actuating element on said one housing in the path of movement of the other of said housings and engageable thereby to effect operation of said actuating means for automatically opening said shutter assembly in response to a predetermined positioning of said plug mating portion within said plug-receiving recess of said receptacle member.

2. A connector assembly as defined in claim 1 wherein said actuator means comprise an electric actuator and a position sensing switch on said one housing operatively coupled to said electric actuator.

3. A connector assembly comprising, in combination:

a receptacle member including a housing having a forward end and a plug-receiving recess extending rearwardly from said forward end;

first contact means disposed within said plug-receiving recess;

a plug member including a housing having a forward mating end portion externally dimensioned for telescoping insertion into said plug-receiving recess;

second contact means disposed within said plug member for engagement with said first contact means when said forward mating portion of said plug member is inserted into said plug-receiving recess;

closure means disposed on at least one of said housings for enclosing the contact means disposed therewithin, said closure means comprising an iris-type shutter assembly; and actuator means disposed on said one of said housings and operatively associated with said shutter assembly disposed thereon, said actuator means including an actuating element on said one housing in the path of movement of the other of said housings and engageable thereby to effect operation of said actuating means for automatically opening said shutter assembly in response to a predetermined positioning of said plug mating portion within said plug-receiving recess of said receptacle member.

4. A connector assembly comprising, in combination:

a receptacle member including a housing having a forward end and a plug-receiving recess extending rearwardly from said forward end;

first contact means disposed within said plug-receiving recess;

a plug member including a housing having a forward mating end portion externally dimensioned for telescoping insertion into said plug-receiving recess;

second contact means disposed within said plug member for engagement with said first contact means when said forward mating portion of said plug member is inserted into said plug-receiving recess;

closure means disposed on at least one of said housings for enclosing the contact means disposed therewithin;

actuator means disposed on said one of said housings and operatively associated with said closure means disposed thereon for automatically opening said closure means in response to a predetermined positioning of said plug mating portion within said plug-receiving recess of said receptacle member;

second closure means disposed on the other of said housings for enclosing the contact means disposed therewithin; and actuator means disposed on said other housing and operatively associated with said second closure means disposed thereon for automatically opening said closure means in response to a predetermined positioning of said plug mating portion within said plug-receiving recess of said receptacle member.

5. A connector assembly as defined in claim 4 wherein each of said closure means and the respective actuator means therefore are independently operable.

* * * * *